United States Patent [19]

Artrip

[11] Patent Number: 4,783,618

[45] Date of Patent: Nov. 8, 1988

[54] APPARATUS AND METHOD FOR CONTROLLING APPARATUS INCLUDING A PLURALITY OF GUIDED UNITS

[75] Inventor: Floyd M. Artrip, Ivy, Va.

[73] Assignee: Acme Visible Records, Inc, Crozet, Va.

[21] Appl. No.: 799,188

[22] Filed: Nov. 15, 1985

Related U.S. Application Data

[63] Continuation-in-part of Ser. No. 657,282, Oct. 3, 1984, abandoned, which is a continuation of Ser. No. 453,173, Dec. 27, 1982, abandoned.

[51] Int. Cl.[4] ..... G05D 1/08

[52] U.S. Cl. ..... 318/587; 180/169; 312/201

[58] Field of Search ..... 318/467, 587; 104/299, 104/288; 312/201; 180/169

[56] References Cited

U.S. PATENT DOCUMENTS

| | | | |
|---|---|---|---|
| 3,249,065 | 5/1966 | Adams et al. | 104/299 |
| 3,537,401 | 11/1970 | Metzner | 104/149 |
| 3,957,323 | 5/1976 | Tucker et al. | 104/288 X |
| 3,973,746 | 5/1975 | Ball | 104/299 X |
| 4,026,654 | 5/1977 | Beaurain | 180/169 X |
| 4,039,040 | 8/1977 | Spears et al. | 104/288 |
| 4,296,901 | 10/1981 | Perrott | 104/299 |
| 4,345,522 | 8/1982 | Miyamoto et al. | 104/89 |
| 4,424,875 | 1/1984 | Yoshida | 318/587 X |

*Primary Examiner*—William M. Shoop, Jr.
*Assistant Examiner*—David S. Martin
*Attorney, Agent, or Firm*—Pennie & Edmonds

[57] ABSTRACT

An apparatus and method for controlling a plurality of movable units for selective movement with respect to one another using operator initiation devices sensitive to heat, capacitance or reflected electromagnetic wave transmissions. Interlock and safety arrangements protect inadvertent unit movement when individuals and objects are interposed between the units.

12 Claims, 6 Drawing Sheets

APPARATUS AND METHOD FOR CONTROLLING APPARATUS INCLUDING A PLURALITY OF GUIDED UNITS

This is a continuation-in-part of application Ser. No. 657,282, filed Oct. 3, 1984 abandoned, which is a continuation, of application Ser. No. 453,173 filed Dec. 27, 1982 abandoned.

BACKGROUND OF THE INVENTION

1. Field of the Invention

This invention relates to controlling a plurality of movable units and, in particular, to a plurality of storage shelf units positioned on a track for selective movement toward and away from one another using devices sensitive to heat, capacitance or reflected electromagnetic wave transmissions to initiate such movement.

2. Prior Art

Numerous systems have been disclosed for causing a plurality of units to move toward and away from one another along guided track arrangements wherein each unit is self-propelled. Manual switches mounted on the ranges are suggested to selectively move each unit in U.S. Pat. Nos. 3,829,189, 3,957,322, 4,017,131 and 4,039,040. Other systems use mechanical arrangements to determine range spacing (see, for example, U.S. Pat. No. 4,033,649). Some systems employ computer units to determine the movement of a set of electrically connected ranges (see, for example, U.S. Pat. No. 3,890,903).

Safety switches are proposed for most systems to stop the ranges to prevent personnel injury or damage to objects as shown in U.S. Pat. No. 3,865,446.

The present invention overcomes many inconveniences and complications of these earlier systems.

SUMMARY OF THE INVENTION

Broadly, the present invention comprises a system in which a plurality of movable units are mounted on guide means in which each unit carries a reversible self-propelling motor, sensor control units and a motor control unit for causing the motor to run forward or in reverse and both limit and safety means for preventing movement of and for stopping the ranges. Each control unit is responsive to signals received from the sensor units which are sensitive to heat, capacitance or reflected electromagnetic waves transmitted by the sensor unit. Each control unit sends signals via flexible cables to a stationary power and control bus panel which in turn carries signals to other ranges in the system. Limit and safety means function to prevent the starting of (or to stop) the motor when the movable range is adjacent a neighboring range; nears another range or a person or an object is interposed between such ranges.

It is a feature that the sensor units sense the presence of an operator's hand to initiate operation without the use of switches, buttons or levers.

It is also a feature that the bus panel may be divided into two or more separately operable sections and that therefore a plurality of selected ranges can operate by being powered from one bus section while the remaining ranges are powered from a second bus section permitting independent operation of each group or ranges.

It is further a feature of the invention that a photo proximity detector mounted on a range detects whether an open aisle exists adjacent to that range and originates an enable signal for alerting other ranges in the arrangement to the presence of the open aisle.

The invention further relates to the use of a sensor unit to control the operation of any apparatus arrangement.

DESCRIPTION OF THE PREFERRED EMBODIMENTS

Figure 1:
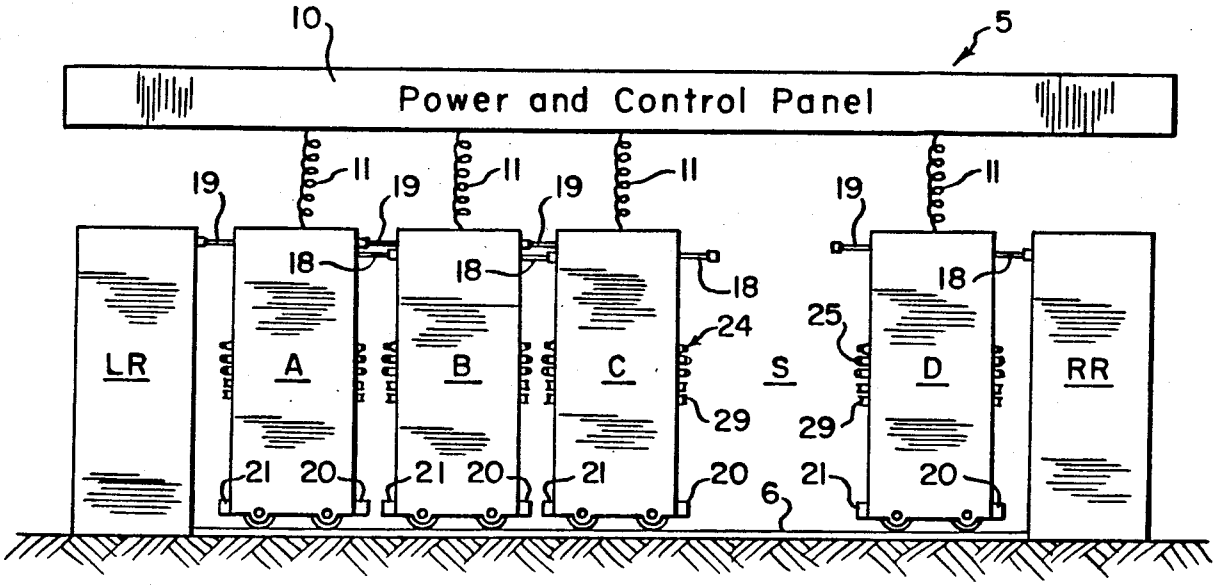
FIG. 1 is an elevational view of a set of stationary LR, RR and movable A–D ranges.

Referring to FIG. 1, arrangement 5 includes wheeled movable shelf ranges, A, B, C and D which can roll right or left on track 6 between stationary ranges LR and RR. Space S provides an access aisle. Each movable range A, B, C and D is connected to the power and control bus panel 10 through a flexible cable 11. Although stationary ranges LR and RR are shown, this system can operate with no stationary ranges, i.e. all ranges being movable. Cable 11 also carries circuits which interconnect with each of the other ranges to start and stop such ranges in response to control signals originating on any range as further described.

Figure 3:
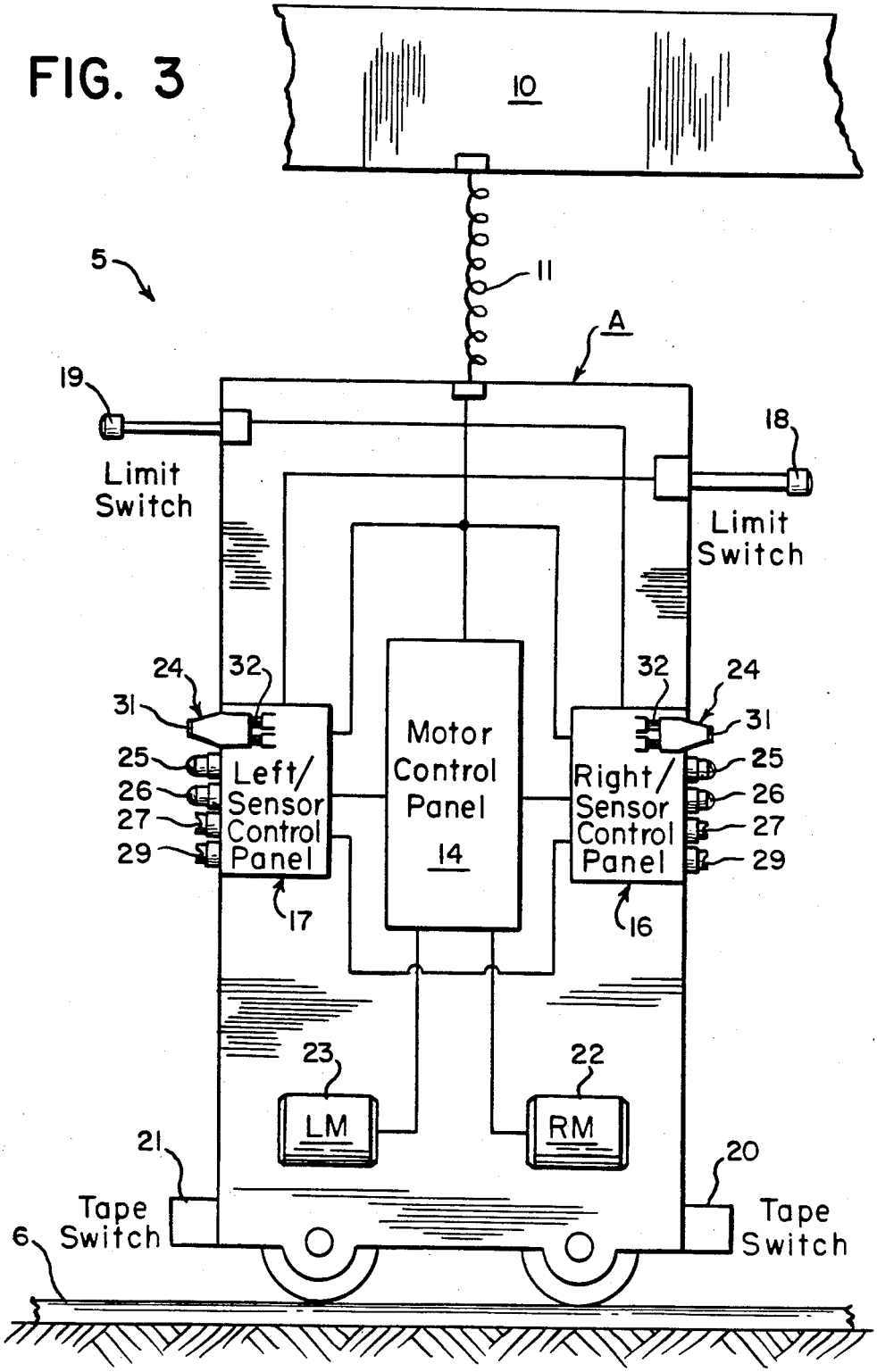
FIG. 3 is a schematic view of the sensor and control arrangement on one of the ranges.

Turning to FIG. 3, range A, like all other movable ranges, is connected to bus panel 10 through cable 11. Each range carries a motor control unit 14, a right sensor/control panel 16, a left sensor/control panel 17, right limit switch 18, left limit switch 19, right safety switch bar 20 and left safety switch bar 21, right motor section 22 and left motor section 23. The limit and safety switches provide de-energizing of the right motor section 22 or left motor section 23 to stop range A when it engages a neighboring range, object or person in its path of its movement.

Each sensor/control panel 16, 17 includes a sensor unit 24, active light 25 indicating the range is energized, a warning light 26 indicating the range has been stopped by operation of a safety switch bar 20, 21; reset test button 27 and an optional key operated on-off switch 29.

Sensor unit 24 emits electromagnetic waves from its nose surface 31 at a selected angle so that when the human hand (or other object) is placed within a close proximity of surface 31 the electromagnetic waves are caused to reflect back toward surface 31 where the reflected waves are received and detected to produce a signal for use in (a) energizing the range and (b) sending signals to other ranges.

Actuating sensor 24 alternately energized and de-energizes the range control means. Starting with no aisles energized, the first actuation of a sensor 24 will energize the sensor/control panels 16, 17 on the ranges on both sides of the aisle at that point. On one side the ranges will move to form the new aisle and fill the previous aisle. 0n the other side the ranges are inhibited by appropriate circuitry from moving due to the adjacent presence of ranges and the fact there is no previously formed aisle to be filled. The operator enters the newly-formed aisle and completes his or her task therein and as he/she exits the aisle he/she again actuates sensor 24 to de-energize the sensor/control panels 16, 17 on all ranges. Until such deenergizing of the sensor/control panels is accomplished no other operator can actuate sensor/control panels 16, 17 in an effort to create a second aisle. This aisle-integrity arrangement insures the safety of the operator when he/she is in the aisle. To alert other potential operators to the presence of the first operator in the aisle, green active lights 25 are lit on all ranges in the arrangement on the side of each range which faces the open aisle. When the operator de-energizes the aisle these green lights extinguish. Should an operator inadvertently leave the aisle energized after leaving the aisle the next operator is alerted to the state of the system being energized and must walk to the open aisle where he/she can see whether it is occupied before de-energizing the aisle. No other sensor/control panels can be used to accomplish deenergizing of the aisle except the panels at that aisle.

Figure 4:
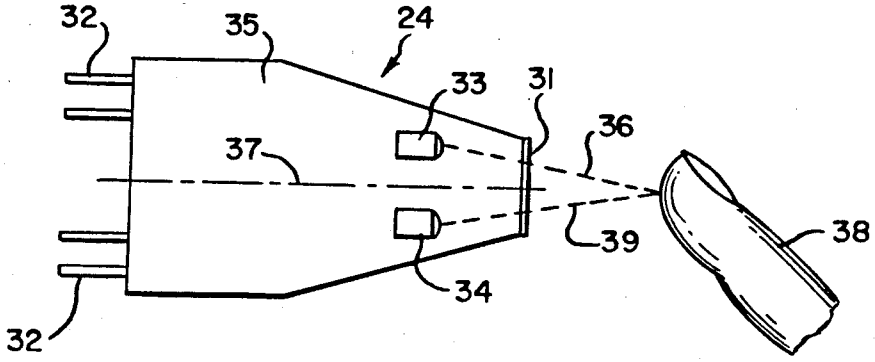
FIG. 4 is an enlarged plan view of a sensor unit.

Turning to FIG. 4, sensor 24 includes plastic body 35, nose surface 31, electrical contacts 32, electromagnetic wave emitter 33 and reflected wave receiver detector 34. The nose surface 31 is installed to provide a convenient location for the operator to place his or her hand to activate sensor unit 24.

Each sensor unit 24 emits electromagnetic waves 36 at a selected angle to center line 37 which waves when striking a finger 38 (or hand or other object) are reflected as return waves 39 to the receiver detector 34 of unit 24. The receipt of waves by the receiver detector 34 produces a signal which passes to sensor/control panel 16 or 17. Each sensor control panel in turn sends signals to activate the motor circuit to cause the motor to run and also sends signals to other ranges as appropriate.

With further references to the operation of the ranges, the operator places his or her had near right sensor 24 of Range A or left sensor 24 of range B. Sensor 24 on detecting the presence of the hand causes a signal to be sent from its associated sensor/control panel 16, 17 through flexible cable 11, bus panel 10, second flexible cable 11 to range C causing the right motor section 22 on range C to drive range C to the right until its limit switch 18 engages range D' and causes range C to stop. Range B is also caused, as part of the sequence initiated, to move to the right until it engages range C. Range B moves out a fraction of a second in time after range C starts to move. The time delay is used to reduce the peak demand for amperage and to prevent ranges from engaging one another as they travel along the track. Range A does not move because its limit switch 19 senses the immediate presence of adjacent range LR.

If range C hits an object or person as it travels safety switch 20 will actuate stopping range C's motor section. Range C's sensor/control panel 16 also disables the group safety bus stopping all other moving ranges in the group and preventing further movement until the person or object is removed and the safety shut down on range C is reset by actuating the reset button. The reset button 27 may also be held depressed and the sensor actuated to operate the range carrying the reset button to move such range to free itself of an object.

Safety bars 20, 21 are located along the length of both faces of each range. These bars are actuated when the range encounters a person or object. When this occurs the range stops causing a red warning light 26 to illuminate indicating the location of the safety stoppage. All other ranges in the group will also stop as a result of the first range having disabled a safety bar. After clearing the cause of the stoppage the range may be reset by actuating the reset button 27. Alternately, if a jam exists which precludes clearing the cause of the stoppage reset button 27 may be held actuated while simultaneously actuating accompanying sensor 24 to move the range away from the sourle of the blockage.

The present apparatus includes a safety bus circuit (not shown) which runs from one end to the other end of the row of ranges via bus panel 10, flexible cables 11 and each and every range. The voltage on the safety bus circuit is maintained within a selected voltage range. All ranges stop moving if there is a failure of the safety bus circuit. The safety bus circuit runs in series through all ranges in the group and failure of this bus by any cause including an open circuit, short to case or short to power supply voltage will cause bus monitor circuits on each range to de-energize all motor control units in the system.

Figure 2:
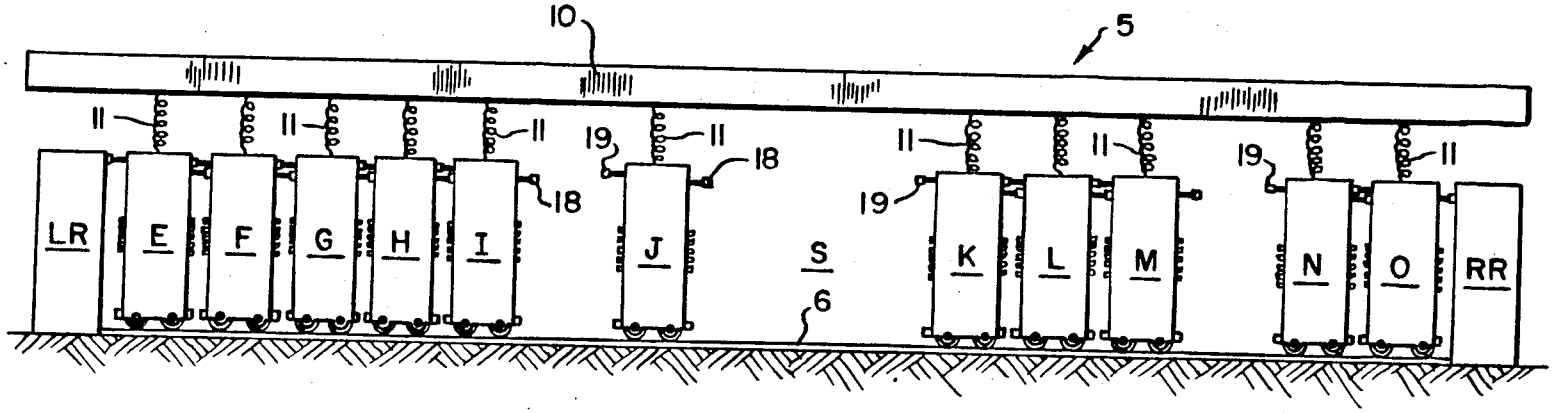
FIG. 2 is an elevational view of a set of stationary LR, RR and movable E–O ranges.

If one of the ranges is de-energized by turning its on-off switch to "off" that range will remain stationary and the ranges to its right will operate as one group while the ranges to the left will operate as a second group; with reference to FIG. 2 if range J is turned off, ranges E–I will form one group and ranges K–0 will form the second group. The safety bus circuit will similarly operate as two separate systems without interaction between groups.

The sensor unit is preferably a device sold by TRW Optron Division of TRW, Inc. under the mark Optron Types OPB 4427. Other sensors which emit and receive reflected wave energy may be used. Also heat and capacitance type sensors may, if desired, be used.

Figure 5:
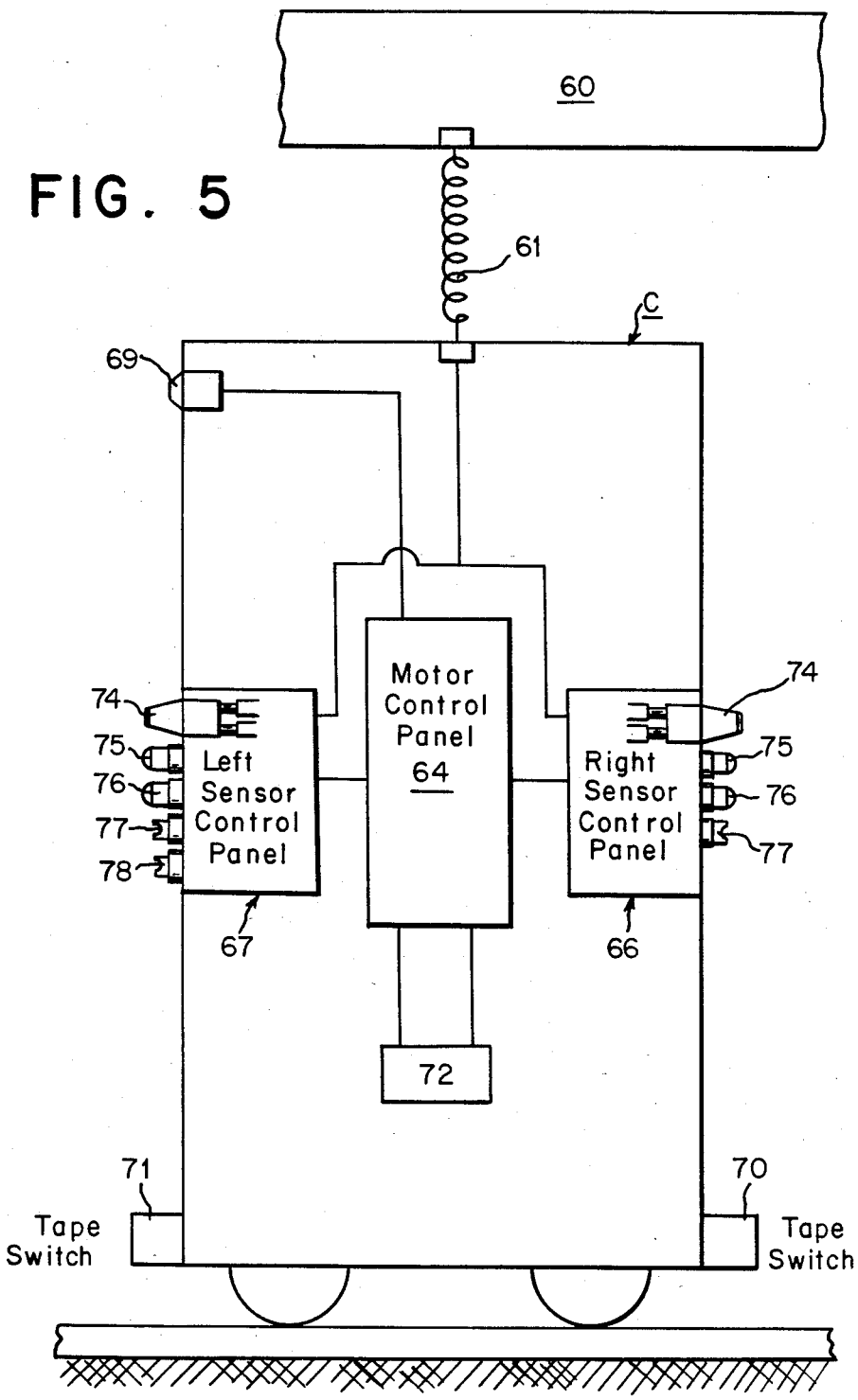
FIG. 5 is a schematic view of the sensor and control arrrangements on one of the ranges in an alternative embodiment of the invention.
Figure 6:
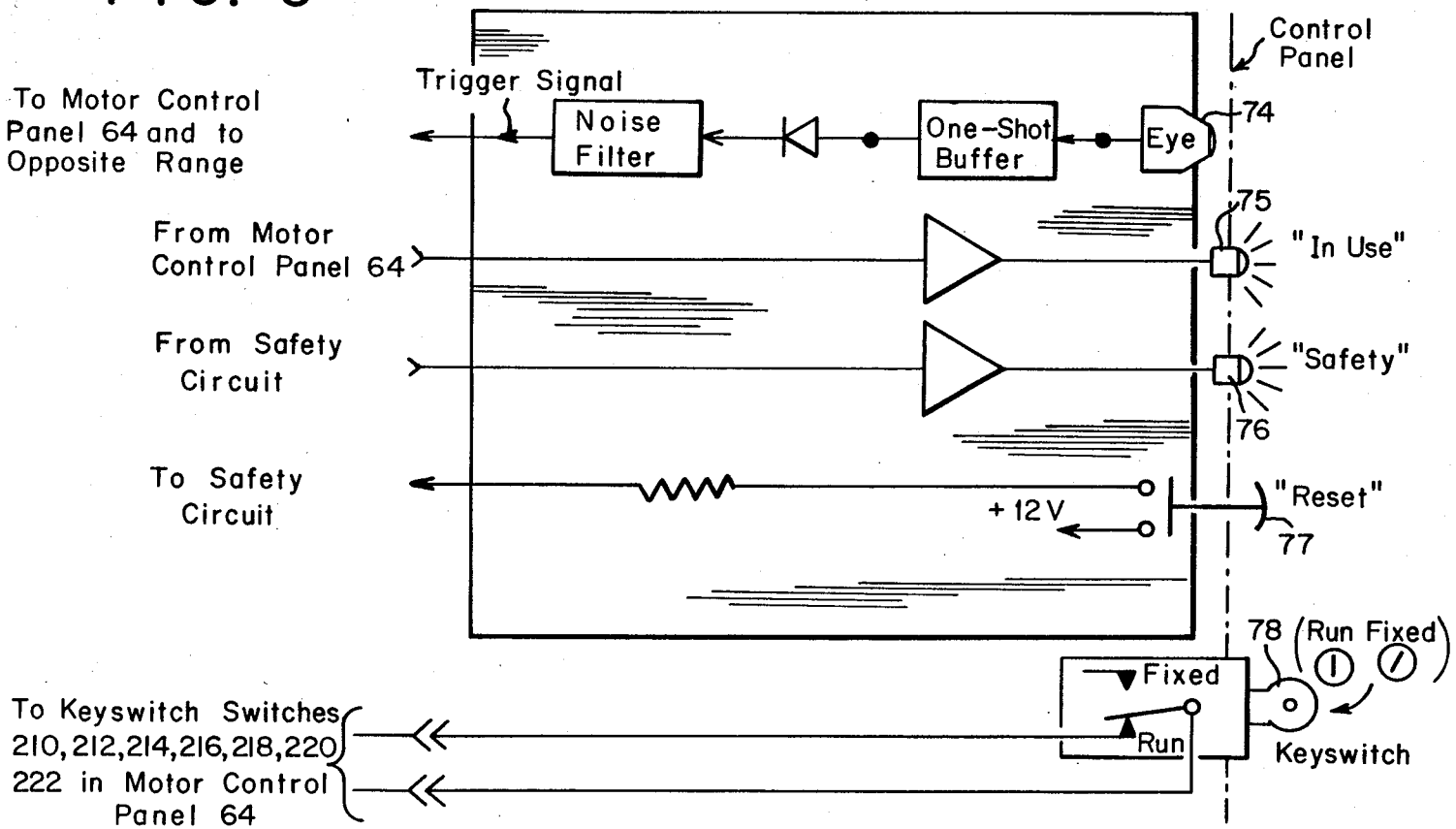
FIG. 6 is a schematic view of a sensor control panel in an a embodiment of the invention.
Figure 7:
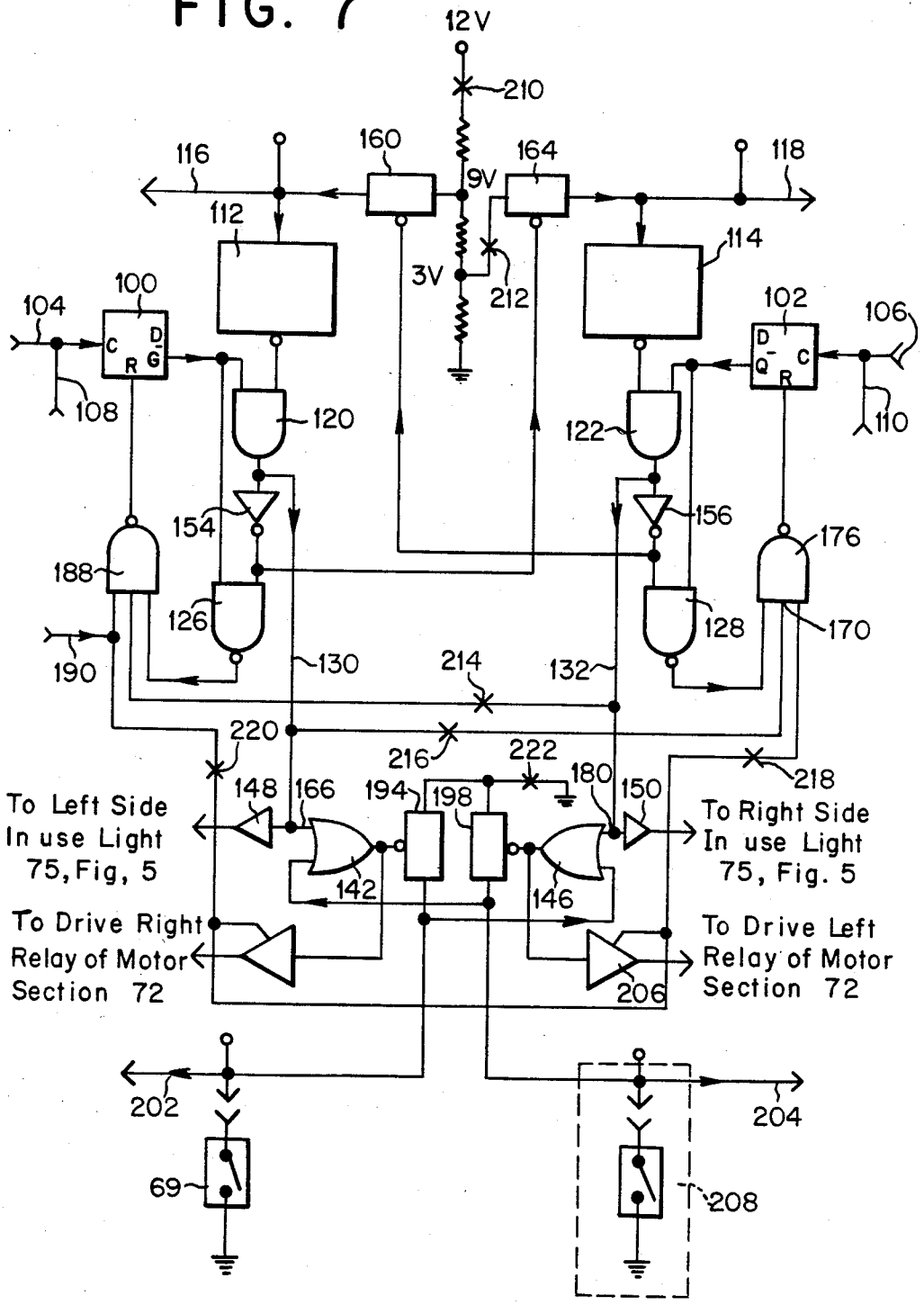
FIG. 7 is a logic diagram of a motor control panel.

FIG. 5, FIG. 6, and FIG. 7 show an alternative embodiment of the invention. Range C in FIG. 5, like all other movable ranges, is connected to a bus panel 60 through cable 61. Each moveable range carries a motor control unit 4, a right sensor control panel 66, a left/sensor control panel 67, photo proximity detector 69, right safety switch bar 70 and left safety switch bar 71, and a motor section 72. Motor section includes a reversible direction motor, a right drive relay which when actuated causes said motor to move the range to the right and a left drive relay which when activated causes said motor to move the range to the left. Safety switches provide signals to safety circuitry (not shown) to inhibit or stop range C when it engages a neighboring range, object or person in its path of its movement and photo proximity detector 69 is used to detect the presence of an adjacent range. Cable 61, includes a command bus right for coupling move commands between range C and range D, a range to the right, a command bus left for coupling move commands between range C and range B, a range to the left, an enable bus right for coupling enable signals between range C and range D, an enable bus left for coupling enable signals between range C and range B, a trigger line right for coupling trigger signals between range C and range D and a trigger line left for coupling trigger line signals between range C and range B.

FIG. 6 shows the sensor/control panels 66, 67 in greater detail. Each sensor/control panel includes a sensor unit 74, in-use light 75 indicating the range is energized, a warning light 76 indicating the range has been stopped by operation of safety switch bar 70, 71, a reset button 77, an optional key operated on-off switch 78, one shot buffer 81 and a noise filter 84.

Sensor unit 74 is preferably identical to sensor unit 24 of FIG. 4. Other sensors which emit and receive reflected wave energy may be used. Also heat and capacitance type sensors may, if desired, be used. It is further contemplated by the invention to code the emitted wave energy, illustratively by modulating said wave energy, and for receiving means of sensor 74 to include decoding means such that the sensor will be responsive only to said coded wave energy being reflected.

When an operator wishes to enter a closed aisle, he/-she places his/her hand near right sensor 74 of the range to the left or left sensor 74 of the range to the right. The signal produced by sensor unit 74 is coupled to one-shot buffer 81 which in turn outputs a trigger signal for approximately one second and at approximately 12 volts, to noise filter 84. The noise filter is of standard design and functions to eliminate induced signals resulting from other circuitry operating in the area. The filtered trigger signal is then communicated to control panel 64 as well coupled as to the range on the opposite side of sensor unit 74, via a trigger line (not shown) of cables 61 and panel 60.

FIG. 7 shows a logic diagram of motor control panel 64. In this embodiment, panel 64 comprises right, left command flip-flops 100, 102 for storing trigger signals received via lines 104, 106 from left/sensor control panel 67 and right/sensor control panel 66, respectively, or from trigger lines left, right 108, 110, respectively, and right, left command detection circuits 112, 114 for detecting [and transmitting] commands via a command bus left 116, command bus right 118, respectively. Right command flip-flop 100 receives trigger signals from left/sensor control panel 67 and from the range opposite said panel. Left command flip-flop 102 operates in an identical manner with respect to right/-sensor control panel 66 and the range opposite that panel. Both right, left command flip-flops are preferably T-type and toggle each time they are clocked. Each of command left, right flip-flops has a reset input (R) which resets the flip-flop when said input receives a high level signal. As used herein, a high or high level signal refers to a potential of more than +11 volts and a low or low level signal refers to a potential of less than +1 volts.

One input of AND gate 120, NAND gate 126, receives the Q- output from flip-flop 100, and one input of AND gate 122, NAND gate 128 receives the Q- output from flip-flop 102. Command right detection circuit 112 is coupled to command bus left 116 and outputs a low signal to AND gate 120 whenever it detects a potential of between two and four volts, which signifies that another range has generated "move right" command. Conversely, left detection circuit 114 is coupled to command bus right 118 and outputs a low level signal to AND gate 122 whenever it detects a potential of between 8 and 10 volts, indicating that another range has generated a "move left" command. Command bus right 118 is coupled by range cables 61 and panel 60 to command bus left of the range immediately to the right and command bus left 116 is similarly coupled to the command bus right of the range immediately to the left.

The outputs of AND gates 120, 122 are Coupled by lines 130, 132 to one input of NAND gates 176, 188, one input of OR gates 142, 146, and buffers 148, 150, respectively. Said outputs are also inverted by invertors 154, 156, and then applied to control bidirectional switches 160, 164, respectively. Bidirectional switches are illustratively CMOS type 4066. When right command flip-flop 100 receives a trigger signal, indicating a move right command, and input R is low, output Q- of flip-flop 100 goes low. The output of AND gate 120 is low and thus input 166 of OR gate 142, to buffer 148 and input 170 of a NAND gate 176 each receive low level signals. Bidirectional switch 164 receives a high level signal and closes, thus coupling 3 volts to command bus right 118. NAND gate 176, because input 170 is low, outputs a high level signal and holds left command flip-flop 102 in a reset state wherein output Q- is high. Alternatively, if command right detection circuit receives a move right command from the range to the left buffer 150, input 180 of OR gate 146, bidirectional switch 160 and input 186 of NAND gate 188 receive the same inputs described above and the reset input of the right command flip-flop held high, inhibiting an operator from causing a move right command.

Thus, when a trigger signal is received from a left/-sensor control panel 67, a trigger signal applied to command left flip-flop 102 will have no effect, but when a given range receives a move right command from another range via command bus left 116, both right, left flip-flops are held reset in range.

The circuitry for processing and generating move left commands operates in a converse manner to that described thus far. When a left command flip-flop 102 receives a trigger signal or command left detection circuit 114 detects a move left command, switch 160 closes to couple a 9 volt signal to command bus left and transmit the move left command, and 0R gate 180, buffer 150 receive a low level signal. Similarly, right command flip-flop 100 is reset when left command flip-flop receives a trigger signal and both flip-flops are held reset when a move left command is detected. Both flip-flops are also reset when a low level signal is coupled to line 190 from the safety circuit described below.

As will be apparent from an examination of the above described circuitry, line 130 is low whenever a range is directed to move right and line 132 is low whenever a range is directed to move left. In-use lights 75 of the sensor control panels receive and are responsive to said low signals.

However, in this embodiment, a range will not move right or left unless it also receives an appropriate enable signal, which in this embodiment is a low level signal. A move right requires that an open aisle exists somewhere to the right of the target aisle. The reverse is true for a move left operation. Bidirectional switches, preferrably CMOS type 4066 and photo proximity detector 69 perform generation and/or processing of enable signals and enable bus right 202, left 204 couple enable signals between ranges.

Illustratively photo proximity detector 69 is sold by Visolux, stock number RL20-8/31 but other appropriately selected detectors can be utilized. When there exists an open aisle to the left of the range, photo proximity detector 69 closes and couples a ground potential to enable bus left 202. Enable bus left 202 is coupled to enable bus right of the range immediately to the left via cable 61 of each range and power and control bus panel 60. Enable bus right 204 is similarly coupled to the enable bus left of the range immediately to the right. Both enable bus left, right are at 12 volts unless ground potential is applied by motor control panel 64.

As stated above, when a new aisle is to be formed all ranges to the right of the target aisle receive a move right command while ranges on the left of said aisle receive a move left command. Taking a move left command as an example, a range can move left if there is an open aisle immediately to the left or if one exists somewhere else further to the left. If there exist an open aisle to the left of the target aisle, enable bus left 202 of the range which on the right side of the open aisle receives an approximately ground potential due to photo proximity detector 69. OR gate 146 now receives two low level input signals; input 180 is low because command left detection circuit sensed the move left command and the other input is low because it is coupled to ground through enable bus left 202. The low level output from OR gate 146 is applied to buffer 206 and closes relay 198, which couples a ground potential to enable bus right.

Assuming that no safety condition has been detected by the safety circuitry, buffer 206 transmits the signal to a left drive relay of motor section 72, which causes the motor in said section to move the range to the left. This sequence of operations will be repeated in every range between the target aisle and the open aisle. As the open aisle closes, photo proximity detector 69 for the range to the right of said aisle moves closer to the opposite range and eventually fires thus removing the ground potential from enable bus left 202 of the range to the right of the closing aisle. OR gate 146 now outputs a high signal, relay 198 opens, removing the enable signal from enable bus right 204. The range stops moving because buffer 206 receives a high signal. This sequence occurs in all of the moving ranges. Examination of the circuitry of FIG. 5 will verify that a move right command is processed in a converse manner. In this embodiment, a second photo proximity detector 208 is used only in the range at the far right of the arrangement to detect, if necessary, whether an open aisle exists. As will apparrent to one skilled in the art, the invention is not limited to the use of a proximity detector for detecting an open aisle to the left. It is equally contemplated by the invention to employ a proximity detector to detect an open aisle to the right in all ranges but the range at the far left, which would use both right and left detectors.

If an open aisle was not present to the left of the target aisle, the only enable signal generated will be output by a range to the right of the target aisle. This enable signal will have no effect on ranges to the left of the target aisle, since said ranges do not receive a move right command and only OR gate 142 receives the enable signal.

After the operator completes his or her task in the newly formed aisle he/she again actuates one of the sensors 74 on either side of the aisle to de-energize the ranges on the left and right sides of the aisle. Until such de-energizing is accomplished, no other operator can actuate different sensor/control panels 66, 67 in an effort to create a second aisle. The second actuation of sensor 74 causes flip-flip 100, for the range to the right of the aisle, and flip-flop 102, for the range to the left of the aisle to toggle and output a high level signal. Consequently, the range ceases originating the move right, move left commands and the flip-flops which were held at reset in said ranges can be clocked again. The other ranges in the system will no longer receive the move left, right signals and all of the left, right flip-flops will similarly have low level signals applied to their reset inputs. This aisle-integrity arrangement helps protect the operator when he/she is in the aisle. While an aisle is open, the green in-use lights 75 are lit on all ranges in the arrangement on the side of each range which faces the open aisle. When the operator de-energizes the aisle these green lights extinguish. Should an operator inadvertently leave the aisle energized after leaving the aisle the next operator is alerted to the state of the system being energized and must walk to the open aisle where he/she can see whether it is occupied before de-energizing the aisle. It will be apparent from the foregoing description of the motor control panel 64 circuitry, that no other sensor/control panels can be used to accomplish de-energizing of the aisle except the panels at the open aisle.

Safety bars 70, 71 are located along the length of both faces of each range. These bars are actuated when the range encounters a person or object, and a safety circuitry (not shown) applies a low signal to line 190, FIG. 5. Said safety circuitry also causes a red warning light 76 to illuminate indicating the location of the safety stoppage. All ranges will stop and reset inputs to all right, left command flip-flops 100, 102 are held high. After clearing, the cause of the stoppage the range may be reset by actuating the reset button 77. Alternately, if a jam exists which precludes clearing the cause of the stoppage reset button 77 may be held actuated while simultaneously actuating accompanying sensor 74 to move the range away from the source of the blockage.

The present apparatus includes a safety bus circuit (not shown) which runs from one end to the other end of the row of ranges via bus panel 60, flexible cables 61 and each and every range. The voltage on the safety bus circuit is maintained within a selected voltage range. All ranges stop moving if there is a failure of the safety bus circuit. The safety bus circuit runs in series through all ranges in the group and failure of this bus by any cause including an open circuit, short to case or short to power supply voltage will cause bus monitor circuits on each range to de-energize all motor control units in the system.

If keyswitch 78, FIG. 6, of one of the ranges is turned to the "off" position, that range will remain stationary and the ranges to its right will operate as one group while the ranges to the left will operate as a second group. More particularly, switches at points 210, 212, 214, 216 and 222 of motor control panel 64, FIG. 7 are opened. Also, a ground potential is coupled to points 218, 220. In this case, no commands are permitted to originate or be passed via the command bus but in-use lights are still energized by commands received. In addition, right, left command flip-flops 100, 102 do not lock each other out and range motor is inhibited from operating. Finally, no enable signals are passed between enable bus left 202 and enable bus right 204, although photo proximity detector 69 can still couple an enable signal to enable bus left.

I claim:

1. In a storage system of ranges mounted in parallel relationship to each other, support guide means for supporting and guiding the ranges as they move on the support guide means, each movable range having motor means for moving the ranges right or left the improvement comprising:

(a) a stationary power and control bus means positioned near the system to serve each range;

(b) flexible cable means connecting each range to said bus means;

(c) motor means on each range for driving its range right or left;

(d) control means on each range;

(e) circuit means connecting the control means of each range through said flexible cable and said bus means;

(f) right and left sensor means on each range for sensing by heat, capacitance or reflected electromagnetic wave the presence of an object adjacent the sensor an object sending a signal to its control means which means in turn sends appropriate signals to other range control means to move ranges left or right in accordance with the selection of the operation.

2. The apparatus of claim 1 having in addition a time delay means associated with the control means to delay for a selected short time after sensor means operation the energizing of the motor means on each of the ranges to be moved except the most remote from the sensor means.

3. The apparatus of claim 1 in which each movable range has an on-off means and control means circuitry such that when the range on-off means is placed in the off condition the bus means is divided to serve all ranges to the right of such range and separately serve all ranges to the left of such range.

4. The apparatus of claim 1 having in addition sensor panel means including a reset button and separate sensor which may be actuated in unison to enable moving a range which has a jammed safety bar.

5. The apparatus of claim 1 in which movement of two adjacent ranges apart forms an aisle and which apparatus includes circuitry means to prevent other ranges from being movable until a sensor on one of said two ranges, after said range movement to form said aisle, has sensed the presence of an object adjacent it.

6. The apparatus of claim 1 having in addition series safety bus means positioned in all ranges and having safety monitor means for monitoring the voltage on the safety bus which monitor means operate to shut down all ranges if said voltage varies beyond a selected range of voltage.

7. The apparatus of claim 1 in which each movable range has a proximity detector for outputting an enable signal whenever said detector detects an open aisle adjacent to said range.

8. A movable range for use in a storage system comprising:

(a) cable means for connecting said range to stationary power and bus means;

(b) motor means for driving said range right or left in accordance with move right and move left signals;

(c) left and right sensor means positioned on the left side and right side of said range for outputting trigger signals when an object in placed adjacent to said sensor means;

(d) right storage means for receiving trigger signals from said left sensor means and from a left trigger line, with said left trigger line being included in said cable means;

(e) left storage means for receiving trigger signals from said right sensor means or from a right trigger line, with said right trigger line being included in said cable means;

(f) a command bus left and a command bus right for communicating move commands;

(g) means for coupling a move left command to said command bus left when a move left command is received from command bus right or when said right storage means receives a trigger signal;

(h) means for coupling a move right command to said command bus right when a move right command is received from said command bus left or when said left storage means receives a trigger signal;

(i) an enable bus left and an enable bus right, included in said cable means, for communicating enable signals;

(j) proximity detector means positioned on one side of said range for, in the case of said detector being positioned on the left side, outputting an enable signal to said enable bus left when an open aisle is adjacent to the left of said range, or for, in the case of said detector being positioned on the right side, outputting an enable signal to said enable be right when an open aisle is adjacent to the right of said range, and (k) enable processing means for coupling a move right signal to said motor means and an enable signal to enable bus left when an enable signal is received from said enable bus right and either a move right command is received from said command bus left or a trigger signal is received by said left storage means and for coupling a move left signal to said motor means and an enable signal to enable bus right when an enable signal is received from enable bus left and either a move left command is received from command bus right or a trigger signal is received by said right storage means.

9. A method of controlling a plurality of movable ranges on a track positioned between two inactive ranges comprising:

(a) providing a power drive means on each movable range and means to start the power drive means to move the range in a direction;

(b) sending the presence of an object nearby one of the ranges desired to be moved;

(c) sending a signal from said sensor to each and every range to be moved which signal as received causes the range to be moved in the desired direction; and (d) employing limit switch means for preventing the range to move when it is in or becomes in engagement with another range.

10. A method of controlling a plurality of movable ranges in a track positioned between stationary ranges comprising:

(a) providing on each movable range right power drive means for driving the range to the right and left power means for driving the range to the left;

(b) emitting energy waves from each movable range;

(c) receiving energy waves emitted from one range as reflected back to said range and detected upon receipt;

(d) causing receipt of such reflected energy waves to create a signal for transmittal through circuit means to other ranges to be moved such that an aisle is formed at the location where the energy waves are reflected; and (e) employing limit switch means for preventing movement of or stopping the range once it is in the proximity of another range.

11. A method of controlling a plurality of movable ranges on a track comprising:

(a) positioning on, near or remote from at least one of said movable ranges apparatus a control means;

(b) providing the control means with emitting means for emitting energy waves therefrom;

(c) providing adjacent such emitting means receiving means for receiving a portion of such energy waves as reflected back;

(d) providing signal producing means which produces a signal in response to the receiving means receipt of said portion of energy waves; and (e) interposing an object near the control means to reflect back emitted energy whereby a signal is generated by the signal producing means.

12. The method of claim 11 wherein said emitted energy waves are coded.

* * * * *